United States Patent [19]

Basten et al.

[11] 4,442,779

[45] Apr. 17, 1984

[54] UNITARY LATCHING AND RELEASE MEANS FOR PORTABLE FOLDABLE WORKBENCH

[75] Inventors: Frank Basten, Brockville; Peter Oxley, Mallorytown, both of Canada

[73] Assignee: Black & Decker Inc., Newark, Del.

[21] Appl. No.: 334,433

[22] Filed: Dec. 24, 1981

[51] Int. Cl.[3] ..... A47B 3/00

[52] U.S. Cl. ..... 108/131; 108/115; 108/125; 269/139

[58] Field of Search ..... 108/125, 126, 121, 115, 108/131, 129; 269/139; 248/166

[56] References Cited

U.S. PATENT DOCUMENTS

| | | | |
|---|---|---|---|
| 1,727,833 | 9/1929 | Kress et al. | 108/125 |
| 2,558,915 | 7/1951 | Sheffer | 108/125 |
| 2,665,181 | 1/1954 | Pucci | 108/131 |
| 3,615,087 | 10/1971 | Hickman | 269/244 |
| 4,169,606 | 10/1979 | Hickman | 269/139 |

FOREIGN PATENT DOCUMENTS

| | | | |
|---|---|---|---|
| 819420 | 10/1937 | France | 108/125 |
| 465437 | 5/1937 | United Kingdom | 108/125 |

*Primary Examiner*—James T. McCall

*Attorney, Agent, or Firm*—R. B. Sherer; H. Weinstein; Charles E. Yocum

[57] ABSTRACT

A pair of manually-manipulatable spring-loaded buttons are accessible outwardly of the side walls of a pair of respective vise brackets secured beneath the table of a portable foldable workbench. When the buttons are pressed laterally inwardly, respective latching mechanisms are released to enable the workbench to be raised from a lowered storage position into an erected working position, and vice-versa. The buttons facilitate a rapid movement of the workbench from one position to another, and the buttons are conveniently located on the workbench for improved ergonomics.

8 Claims, 9 Drawing Figures

UNITARY LATCHING AND RELEASE MEANS FOR PORTABLE FOLDABLE WORKBENCH

BACKGROUND OF THE INVENTION

Portable foldable workbenches have been manufactured and sold, such as those described and claimed in U.S. Letters Pat. No. 3,615,087 issued on Oct. 26, 1971. These workbenches have a table, a base, and a supporting structure therebetween. The supporting structure is pivotably connected to the base and table, respectively, thereby enabling the workbench to be moved from a raised erected position into a lowered storage position, and vice-versa. First and second resiliently-biased latching means, separate and distinct from one another, are provided to maintain the workbench in its raised and lowered positions, respectively; and each of these latching means may be selectively released to enable the workbench to be moved from one position into another position. This selective unlatching is facilitated by manually-manipulatable release means, which like the latching means, are complete separate and distinct from each other. While completely functional and satisfactory for the purposes intended, nevertheless, the latching means and the manually-manipulatable release means could be improved.

SUMMARY OF THE INVENTION

Accordingly, it is an object of the present invention to provide an improved latching and release means for a portable foldable workbench of the type described.

It is another object of the present invention to provide, in a workbench of the type described, a single unitary release means which is selectively operable to disengage either the first or second latching means, respectively.

It is yet another object of the present invention to provide, in a workbench of the type described, a single manually-manipulatable actuator button for improved ergonomics.

It is a further object of the present invention to provide a release means which cooperates with the pivoting supporting structure to reduce any looseness in the portable foldable workbench.

It is a still further object of the present invention to reduce the number of components and their assembly time, thus further facilitating the economical fabrication and manufacture of the workbench on a volume mass-production basis.

In accordance with the teachings of the present invention, the portable foldable workbench includes a base, a table having a pair of spaced brackets secured thereto, each bracket having a slotted opening formed therein, and an intermediate supporting structure pivotably connected between the brackets and the base and including a pair of transverse supporting struts, one for each of the brackets. A unitary latching and release mechanism is provided between the table and the supporting structure, and between the supporting structure and the base, respectively. This mechanism includes a first latching means which is automatically operative between the pivoted supporting strut and the bracket as the workbench is raised into its erected position, and a first resilient means maintains the first latching means in its engaged position in the erected position of the workbench. A second latching means is automatically operative between the bracket and the base, as the workbench is lowered into its storage position, and a second resilient means maintains the second latching means in its engaged position in the lowered position of the workbench. Means are provided, including a single manually-manipulatable button adapted to be pressed laterally inwardly of the bracket, for selectively releasing either the first or second latching means against the bias force of the first and second resilient means, respectively, thereby enabling the workbench to be moved from one position to another.

These and other objects of the present invention will become apparent from a reading of the following description, taken in conjunction with the enclosed drawings.

DESCRIPTION OF THE PREFERRED EMBODIMENT

Figure 2:
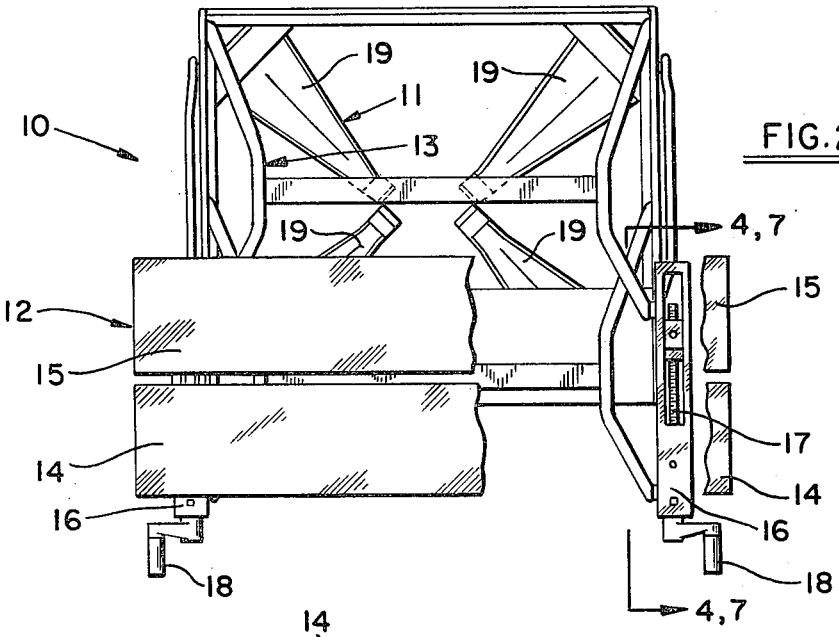
FIG. 2 is a top plan view thereof, with part of the table being broken away to shown one of the vise brackets.
Figure 1:
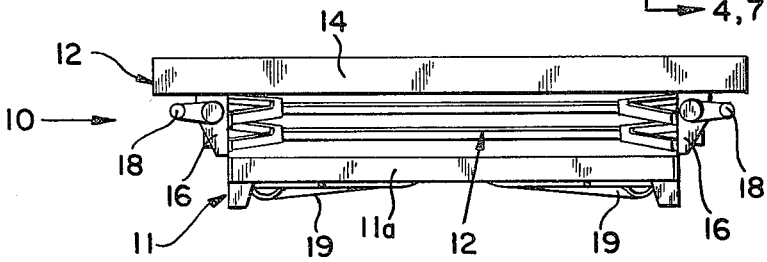
FIG. 1 is a front elevation of the workbench folded into its lowered, storage position.
Figure 3:
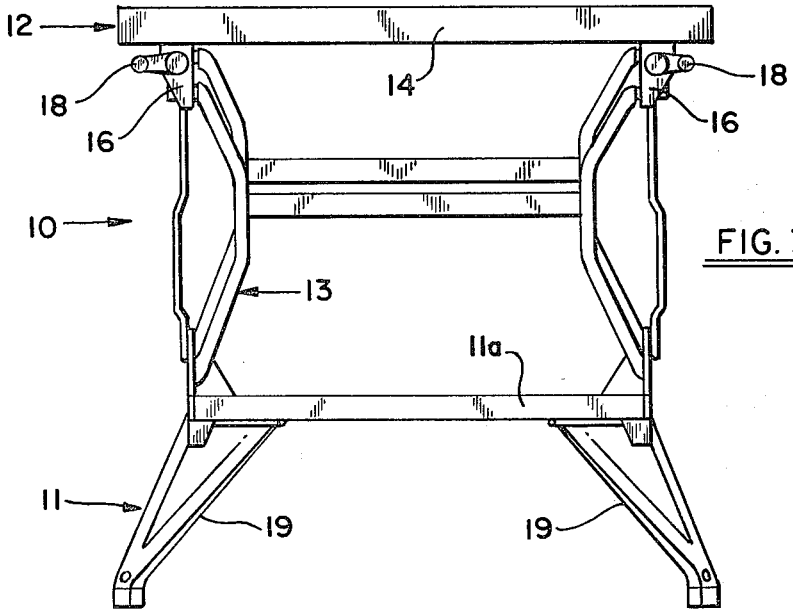
FIG. 3 is a front elevation of the workbench in its raised, erected position.

With reference to FIGS. 1-3, there is illustrated a portable foldable workbench 10 with which the teachings of the present invention may find more particular utility. It will be appreciated, however, that the broad teachings of the present invention are not confined to the specific workbench 10, but rather are equally applicable to a wide variety of portable or foldable benches and worktables suitable for use by carpenters, mechanics, and home craftsmen. With this in mind, the workbench generally comprises a base 11 including a step 11*a*, a table 12, and an intermediate supporting structure 13. The supporting structure facilitates a collapsing or folding of the workbench from its erected position (as shown in FIG. 3) into its lowered compact position (as shown in FIGS. 1 and 2) for convenient storage and portability. In the lowered position of the workbench, its table lies substantially parallel to the base and in spaced juxta-position thereto. Additionally, the supporting structure facilitates the raising of the workbench from its lowered storage position into its erected position (as hereinafter described).

Preferably, but not necessarily, the table of the workbench is formed integrally as a giant vise, including a fixed front vise jaw 14 and a movable rear vise jaw 15. These vise jaws are elongated, as shown in FIG. 2, and are disposed transversely of a pair of spaced parallel vise brackets, one of which is shown as at 16 in FIG. 2. The front vise jaw is fixed to the brackets, and the rear vise jaw is supported on the brackets for movement towards the front vise jaw for clamping a workpiece therebetween. The means for moving the rear vise jaw includes a pair of independently-operable screw-threaded rods 17 actuated by respective crank handles 18, as shown in FIG. 2.

The vise mechanism and table structure, as well as the pivotable intermediate supporting structure between the base and the table, form no part of the present invention and are disclosed in the aforesaid U.S. Letters Pat. No. 3,615,087. Moreover, the base includes four pivotable legs 19, which provide a dual-height feature; this feature allows the workbench to be used either as a saw horse or as a bench. Again, the leg structure forms no part of the present invention, being disclosed in U. S. Letters Pat. No. 4,034,684 issued on July 12, 1977.

Figure 7:
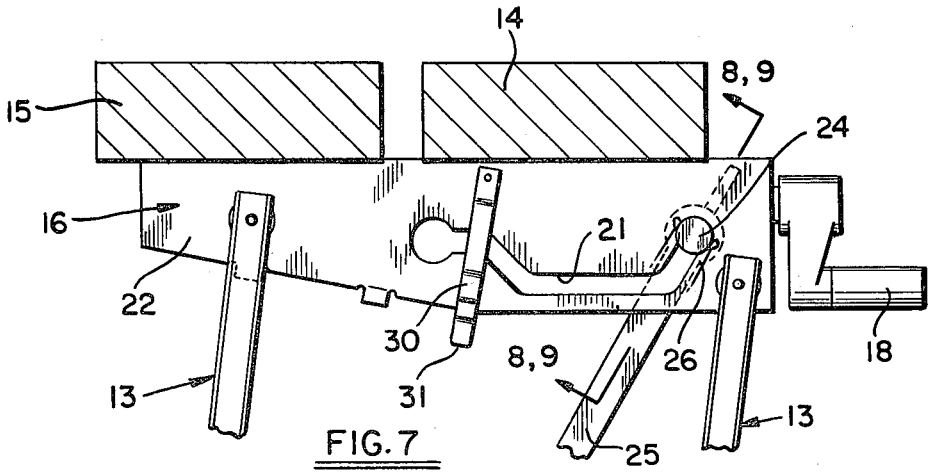
FIG. 7 corresponds to FIG. 4, but shows the mechanism in its alternate position in the erected position of the workbench.
Figure 8:
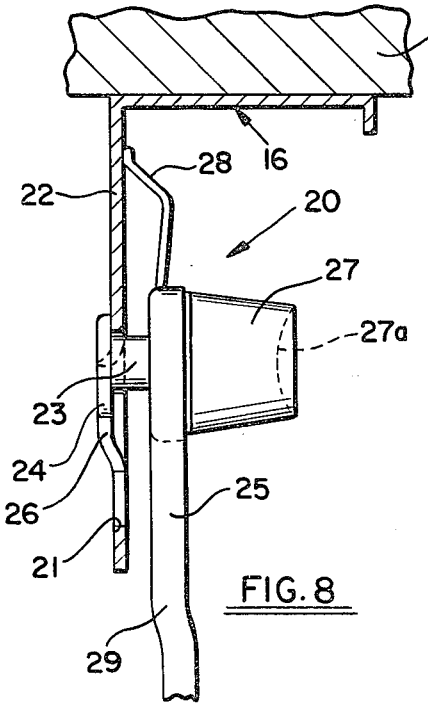
FIG. 8 is a section view, taken along the lines 8—8 of FIG. 7, and showing a first latching means operative between the bracket and the pivoted supporting strut to retain the workbench in its erected position.

With reference to the remaining drawings, a pair of unitary latching and release mechanisms 20 are provided in accordance with the teachings of the present invention. The mechanisms are located on respective sides of the workbench, and since the mechanisms are identical, only one mechanism will be described herein. A slotted opening 21 is formed in a side wall 22 of each vise bracket, and a stud 23 having a shouldered portion 24 is slidably received in the slotted opening. The stud is pivotably connected to a transverse supporting strut 25 (which is part of the intermediate supporting structure of the workbench). Near one end of the slotted opening, and on either side thereof, a raised emboss 26 is formed in the side wall of the bracket. The stud is normally received in the end of the slotted opening and adjacent to the raised emboss, as shown in FIGS. 7 and 8, in the erected position of the workbench.

Figure 9:
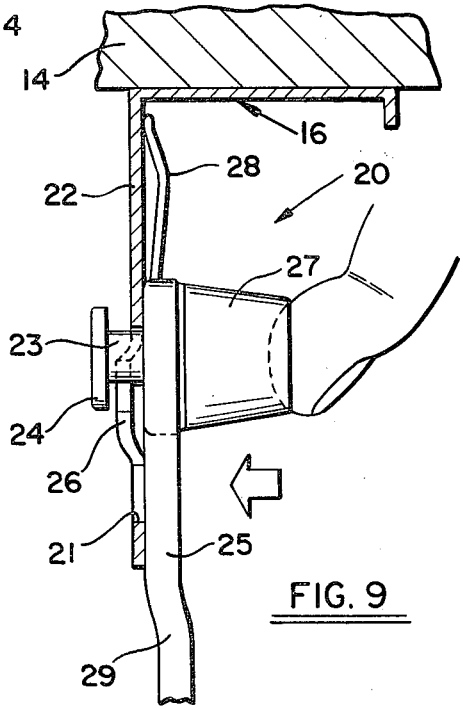
FIG. 9 corresponds to FIG. 8, but shows the first latching means released to disengage the bracket and the strut.

A manually-manipulatable button 27 (formed with a concave recess 27*a*) is secured to the stud on the other side of the wall. The button has an integral spring finger 28 bearing against the side wall of the bracket, thereby providing a resilient bias force on the stud. The button is accessible outwardly of the bracket (and hence outwardly of the workbench) and may be pressed laterally inwardly of the bracket (in the direction of the arrow in FIG. 9) so as to lift the stud away from the side wall of the bracket, thereby enabling the stud to clear the raised emboss, and thereby enabling the stud to thereafter slide in one direction along the slotted opening in the bracket. As the stud slides within the slotted opening, the pivoted supporting strut is carried conjointly therewith, thereby facilitating the collapsing or folding of the workbench from its erected position into its lowered position. Moreover, the supporting strut is deliberately bent, as at 29, thereby providing an additional resilient bias on the stud.

Figure 4:
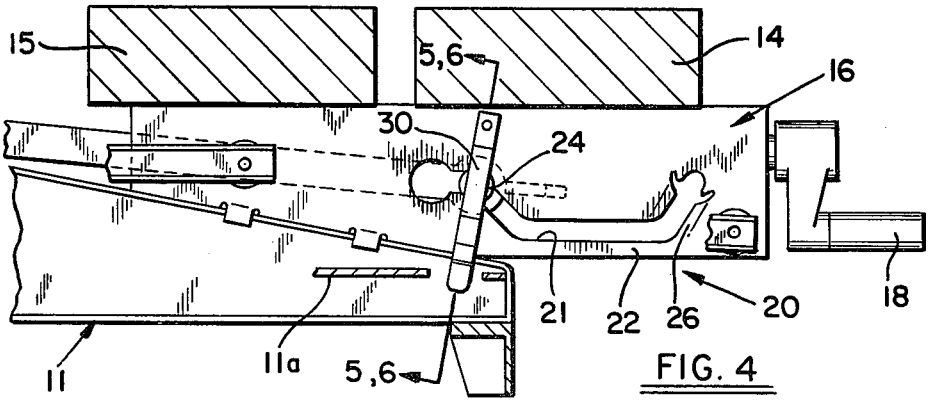
FIG. 4 is a view, taken along the lines 4—4 of FIG. 2 and drawn to an enlarged scale, showing the components of the unitary latching and release mechanisms of the present invention.
Figure 5:
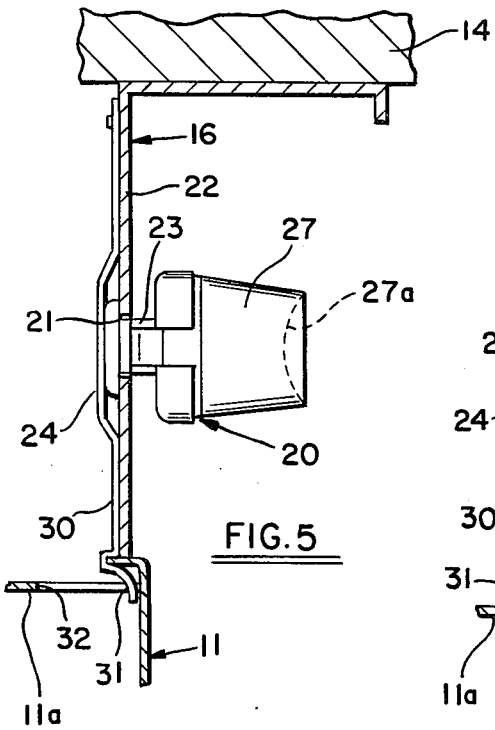
FIG. 5 is a section view, taken along the lines 5—5 of FIG. 4, and showing a second latching means operative between the bracket and the base to retain the workbench in its lowered position.
Figure 6:
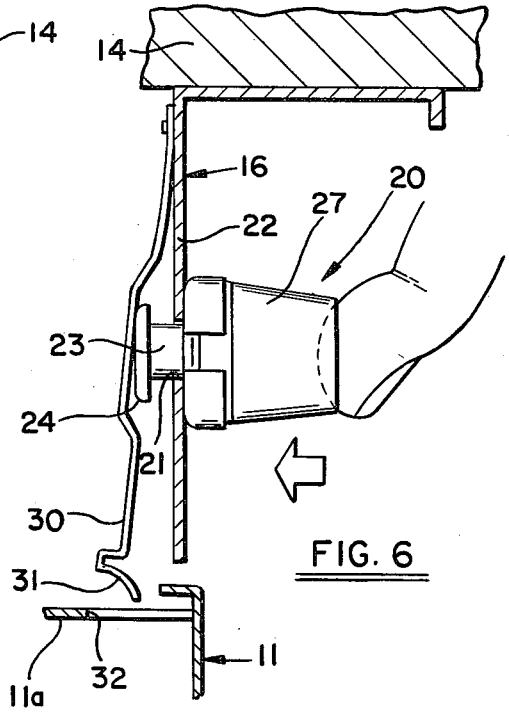
FIG. 6 corresponds to FIG. 5, but shows the second latching means released to disengage the bracket from the base.

The alternate position of the stud in the slotted opening, corresponding to the lowered position of the workbench, is shown in FIGS. 4 and 5. In this position, the stud is received near the other end of the slotted opening in the bracket. A spring latch 30 has one end thereof welded (or otherwise secured) to the side wall of the bracket, overlying the stud, and has a bent opposite end portion 31 extending beyond the bracket and received within an opening 32 formed in the step portion of the base. With this arrangement, the supporting structure of the workbench is automatically latched to the base, as the workbench is lowered into its storage position. When it is desired to raise the workbench, the button is again pressed laterally inwardly (in the direction of the arrow in FIG. 6), thereby pressing against the spring latch, and thereby releasing the end of the latch from the opening in the base. Thereafter, the stud may be moved in the opposite direction in the slotted opening in the bracket, and the stud will ride over the raised emboss and will be received in the one end of the slotted opening with a "snap action", thereby maintaining the workbench in its erected position.

Thus, a first latching means is provided between the table and the supporting structure, which is automatically operative as the workbench is raised into its erected position, and a first resilient means is provided for maintaining the first latching means. Moreover, a second latching means is provided between the supporting structure and the base, which is automatically operative as the workbench is lowered into its storage position, and a second resilient means is provided for maintaining the second latching means. More significantly, however, the means for selectively releasing the first and second latching means, against the bias force of the first and second resilient means, respectively, comprises a single unitary manually-manipulatable member—the button 27—thereby facilitating the rapid and convenient movement of the workbench from one position into another. Additionally, the operator knows instinctively which member (the button) to press to release the respective latches—the member is the same for raising or lowering the workbench —and thus the ergonomics are substantially improved.

Obviously, many modifications may be made without departing from the basic spirit of the present invention. Accordingly, it will be appreciated by those skilled in the art that within the scope of the appended claims, the invention may be practiced other than has been specifically described herein. We claim:

1. In a portable foldable workbench having a raised erected position and a lowered storage position, the workbench including a base, a table having a pair of spaced parallel brackets secured thereto, and an intermediate supporting structure pivotably connected between the brackets and the base and including a pair of transverse pivoted supporting struts, one for each of the brackets, a unitary latching and release mechanism between the table and the supporting structure, and between the supporting structure and the base, respectively, the unitary latching and release mechanism comprising, in combination, a stud connected to one end of each supporting strut, each bracket having a slotted opening formed therein to slidably receive the stud, a raised emboss formed on the bracket near one end of the slotted opening therein, the stud being normally received at the one end of the slotted opening and adjacent to the raised emboss therein in the erected position of the workbench, resilient means constantly urging the stud in its normal position within the slotted opening, a manually-manipulatable button secured to the stud and accessible outwardly of the workbench, whereby the button may be pressed laterally inwardly against the bias of the resilient means to clear the stud from the raised emboss and enable the stud to slide in one direction within the slotted opening, and whereby the supporting strut will be carried conjointly with the stud, thereby enabling the workbench to be folded into its lowered position, the stud being received at the other end of the slotted opening in the lowered position of the workbench, a spring latch secured to the bracket transversely of the slotted opening and overlying the stud in the lowered position of the workbench, the latch having an end portion extending beyond the bracket, and the base having an opening formed therein to receive the end portion of the latch, thereby retaining the workbench in its lowered position, whereby the button may again be pressed laterally inwardly to push the stud against the latch and clear the end portion of the latch from the opening in the base, thereby enabling the workbench to be raised, and whereby the stud slides in the opposite direction within the slotted opening and rides over the raised emboss with a snap-action to retain the workbench in its erected position.

2. The combination of claim 1, wherein the resilient means comprises a spring finger formed integrally with the button and bearing against a side of the bracket.

3. The combination of claim 1, wherein the pivoted supporting strut is bent to provide an additional resilient bias on the stud.

4. The combination of claim 1 wherein the button has a concave recess formed therein to facilitate its manual manipulation.

5. The combination of claim 1, wherein the slotted opening is formed in a side wall of the bracket, and wherein the stud has a shouldered portion bearing against one side of the bracket wall, the button being accessible on the other side of the wall.

6. In a portable foldable workbench having a raised erected position and a lowered storage position, the workbench including a base, a table having a pair of spaced parallel brackets secured thereto, and an intermediate supporting structure pivotably connected between the brackets and the base and including a pair of transverse pivoted supporting struts, one for each of the brackets, a unitary latching and release mechanism between the table and the supporting structure, and between the supporting structure and the base, respectively, the unitary latching and release mechanism comprising, in combination, a shouldered stud connected to one end of each supporting strut, the bracket having a side wall with a slotted opening formed therein to slidably receive the stud, a raised emboss formed on the bracket near one end of the slotted opening therein, the stud being normally received at the one end of the slotted opening and adjacent to the raised emboss therein in the erected position of the workbench, a manually-manipulatable button secured to the stud on the other side of the bracket wall and accessible outwardly of the workbench, the button having a spring finger formed integrally therewith, the spring finger bearing against the side wall of tne bracket and providing a resilient bias for constantly urging the stud in its normal position in the slotted opening in the erected position of the workbench, the supporting strut being bent to provide a back-up resilient bias on the stud, whereby the button may be pressed laterally inwardly against the resilient bias of the spring finger and supporting strut to clear the stud from the raised emboss and enable the stud to slide in one direction within the slotted opening, and whereby the pivoted supporting strut will be carried conjointly with the stud, thereby enabling the workbench to be folded into its lowered position, the stud being received at the other end of the slotted opening in the lowered position of the workbench, a spring latch secured to the bracket transversely of the slotted opening and overlying the stud in the lowered position of the workbench, the latch having an end portion extending beyond the bracket, and the base having an opening formed therein to receive the end portion of the latch, thereby retaining the workbench in its lowered position, whereby the button may again be pressed laterally inwardly to push the stud against the latch and clear the end portion of the latch from the opening in the base, thereby enabling the workbench to be raised, and whereby the stud slides in the opposite direction within the slotted opening and rides over the raised emboss with a snap-action to retain the workbench in its erected position.

7. In a portable foldable workbench having a raised erected position and a lowered storage position, the workbench including a base, a table having a pair of spaced brackets secured thereto, each bracket having a slotted opening formed therein, and an intermediate supporting structure pivotably connected between the brackets and the base and including a pair of transverse pivoted supporting struts, one for each of the brackets, a unitary latching and release mechanism between the table and the supporting structure, and between the supporting structure and the base, respectively, the unitary latching and release mechanism comprising, in combination, first latching means automatically operative between the pivoted supporting strut and the bracket as the workbench is raised into its erected position, first resilient means for maintaining the first latching means in its engaged position in the erected position of the workbench, means including a manually-manipulatable button adapted to be pressed laterally inwardly of the bracket and against the bias force of the first resilient means to release the first latching means, therby enabling the supporting strut to be pivoted relative to the bracket, and thereby enabling the workbench to be lowered into its storage position, second latching means automatically operative between the bracket and the base as the workbench is folded into its lowered position, second resilient means for maintaining the second latching means in its engaged position in the lowered position of the workbench, and means responsive to further lateral inward movement of the button against the bias force of the second resilient means to release the second latching means, thereby disconnecting the bracket from the base and enabling the workbench to be raised.

8. In a portable foldable workbench having a raised erected position and a lowered storage position, the workbench including a table having at least one supporting member secured thereto, a base, and an intermediate structure between the base and the table, the intermediate structure including a transverse supporting strut pivotably connected between the base and the supporting member of the table and having a limited sliding movement relative to the supporting member, latching means between the strut and the supporting member for retaining the strut in one position relative to the supporting member, corresponding to the erected position of the workbench, the latching means including a stud connected to one end of the strut, the supporting member having a slotted opening formed therein to slidably receive the stud, a raised emboss formed on the supporting member near one end of the slotted opening therein, the stud being normally received at the one end of the slotted opening and adjacent to the raised emboss therein in the erected position of the workbench, resilient means constantly urging the stud in its normal position within the slotted opening, and manually-manipulatable means for counteracting the resilient means for clearing the stud from the raised emboss so that the stud is enabled to slide within the slotted opening and the supporting strut is carried conjointly with the stud, thereby enabling the workbench to be lowered from its erected position into its storage position.

* * * * *